United States Patent [19]

Sidler

[11] Patent Number: 4,577,563

[45] Date of Patent: Mar. 25, 1986

[54] SAFEKEEPING BOX ASSEMBLY

[76] Inventor: Karl J. Sidler, 420 Touzin Ave., Dorval, Quebec, Canada, H9S 2N2

[21] Appl. No.: 629,902

[22] Filed: Jul. 11, 1984

[51] Int. Cl.[4] ..... E05G 1/04

[52] U.S. Cl. ..... 109/52; 109/59 T; 220/18; 248/553

[58] Field of Search ..... 109/50–52, 109/59 R, 59 T; 248/551, 552, 553; 70/62, 63, 160, 161; 220/18

[56] References Cited

U.S. PATENT DOCUMENTS

| | | | |
|---|---|---|---|
| 1,796,502 | 3/1931 | Boucher | 109/52 |
| 3,146,739 | 9/1964 | Furman | 109/52 |
| 3,741,132 | 6/1973 | Blower | 109/52 |
| 4,244,304 | 1/1981 | Read | 109/52 |
| 4,493,268 | 1/1985 | Sidler | 109/52 |

FOREIGN PATENT DOCUMENTS

| | | | |
|---|---|---|---|
| 1017185 | 12/1952 | France | 109/52 |

*Primary Examiner*—Kenneth J. Dorner
*Assistant Examiner*—Neill Wilson
*Attorney, Agent, or Firm*—Robic, Robic & Associates

[57] ABSTRACT

A safety box assembly comprising a safety container of the portable and carrying type, and a mounting base intended to be fastened on a supporting surface such as the floor or the wall of a room. The assembly further comprises a locking arrangement whereby the container may be released from its mounting base to be carried about, the base remaining on the supporting wall. This assembly is conceived so that only by unlocking the locking arrangement can the safety container be opened and removed from its mounting base. The assembly is also conceived so that unless the safety container is unlocked and removed from the mounting base, it is not possible to unfasten the mounting base from its supporting surface and therefore to carry the whole assembly from its selected location.

14 Claims, 3 Drawing Figures

SAFEKEEPING BOX ASSEMBLY

BACKGROUND OF THE INVENTION

1. Field of the invention

The present invention relates to a safety box assembly of the type comprising a safety container or the portable and carrying type, and a mounting base intended to be fastened on a supporting surface such as the floor or wall of a room, the assembly further comprising a locking arrangement whereby the container may be released from its mounting base to be carried about, the base remaining on the supporting wall.

More particularly, the invention relates to a safety box assembly of the above mentioned type, which assembly is conceived so that only by unlocking the locking arrangement can the safety container be opened and removed from its mounting base. The assembly is also conceived so that unless the safety container is unlocked and removed from the mounting base, it is not possible to unfasten the mounting base from its supporting surface and therefore to carry the whole assembly from its selected location.

2. Description of the prior art

Safe box assemblies of the above mentioned type are already known and presently available in the market. These assemblies are very useful to those who have to collect money or other valuables by motor vehicles, such as delivery trucks, mild trucks, taxi cabs or the like, where important sums of money or other valuables are involved. In such instances, the mounting base is secured to the body of the vehicle and the safety container is locked to it so that it can be removed only by the driver of the vehicle or by another person who has the key.

Of course, greater safety from theft is obtained if the driver does not carry the key with him. In this particular case, a slot is provided through the container to place valuables therein, the slot being or course too narrow to allow hand access to the inside of the box. Since the above type of vehicles is nearly always in public view, a thief could not successfully hold up the driver since the latter would not have the key on him nor would the thief have sufficient time to dismantle the assembly by force before some police or other reinforcement becomes available.

Safety box assembles of the above mentioned type may also be extremely useful in public places such as hotels and motels where each room may be provided with a mounting base. A plurality of containers matching with the mounting bases are made available at the hotel or motel desk and returned by the client upon leaving. Provided that the locking arrangement of each assembly is carried in the container and that each arrangement has particular locking combination there will be almost no point for a prospective thief to have a copy made of a particular key since he will not know in which room is located the container provided with the particular locking arrangement to which the copied key fits.

It will also be appreciated from the above comments that safety box assemblies of this type may further be used with the same success in private and apartment houses, summer cottages, home offices, construction sites for the safe keeping of explosives, etc.

These assemblies could also be rented out by tool or appliance rental companies for the above-noted purpose.

As aforesaid, safety box assemblies of the type including a fixed mounting base to which a container for valuables can be secured to prevent theft is known. Such an assembly is disclosed, by way of example in U.S. Pat. No. 2,465,057. In the assembly of this patent, the safety container can easily be moved between two or more fixed mounting bases and then securely locked to whatever mounting base it is applied to.

It is noticeable however that the known safety box assemblies are quite complicated in construction and require one locking means to secure the safety box to the mounting base and another lock to secure the door to the box.

In order to be of any value, however, a safety box assembly of this nature has to be quite simple not only in operation, being intended for people not normally apt to handle complicated constructions and having little time to spend in studying how a device works, but because such assemblies have to be by nature low in selling price, installation and maintenance costs.

SUMMARY OF THE INVENTION

It is consequently a main object of the present invention to provide an improved safety box assembly which incorporates the above mentioned advantages of ease and use, construction and maintenance costs. The simplicity in construction also allows the use of sturdy metallic components as is the case in any safety box assemblies.

In accordance with the present invention, this main object is achieved in an improved safety box assembly of the type comprising:

(a) a container defining an enclosure for the safekeeping of valuables, this container having a bottom wall and wall edges at one end defining an opening;

(b) a door hinged to the container for closing the opening;

(c) a mounting base having a bottom wall and means for allowing rigid fixation of this bottom wall onto a supporting surface; and (d) means for removably securing the container onto the mounting base over the fastening means whereby to render these fastening means inaccessible when the container is so secured, these securing means comprising:

releasable interlocking means at the end of the container which is opposite to the opening for securing this opposite end to one end of the mounting base; and locking means for simultaneously locking the door in the opening and securing the end of the container where is defined the opening to the other end of the mounting base.

This safety box assembly is improved in that its locking means comprises:

a lock mechanism mounted on and fixed to the door of the container;

hooking means movable by the lock mechanism; and retaining means on the container and mounting base respectively, for simultaneously receiving the hooking means when the door is locked, whereby engagement of the hooking means is the retaining means when the door is closed and the lock mechanism operated, causes simultaneous attachment of the door, the container and the mounting base by the hooking means with the door locked in closed position and the container secured onto the mounting base.

In accordance with a preferred embodiment of the invention, the retaining means for receiving the hooking means consist of a pair of facing slots respectively provided for in the bottom wall of the container and the horizontal wall of a bracket upstanding from the bottom wall of the base so as to be in contact with the bottom wall of the container. The facing slots then are positioned to receive the hooking means when the door is closed and the lock mechanism operated.

In the same preferred embodiment, the hooking means may comprise a latch connected at one end to the lock mechanism, this latch having its other end provided with a lateral notch capable of engaging and simultaneously hooking the bottom wall of the container and the horizontal wall of the bracket of the mounting base when the door is closed and the latch is moved through the facing slots by operation of the lock mechanism.

The lock mechanism may include means to rotate the latch in a plane substantially parallel to the door between a disengaged position where the door is openable and the container removable from the base, and an engaged position where the notched end of the latch is inserted in the facing slots and hooked onto the bottom wall of the container and the horizontal wall of the bracket of the mounting base, respectively.

The door is preferably hinged to the container for pivotal action about an axis which is parallel to the bottom wall of the mounting base. However, it could also be hinged to pivot about an axis which is perpendicular to the mounting base.

If desired, a slot may be provided through the top wall of the container to five limited access thereto for the insertion of valuables. To be useful, this slot must of course be of a size suitable to prevent hand access into the container.

A handle may also be formed on the top wall of the container for carrying the same when it is released from the mounting base.

A preferred embodiment of the invention will now be described in detail having reference to the accompanying drawings.

BRIEF DESCRIPTION OF THE DRAWINGS

In the accompanying drawings.

DESCRIPTION OF A PREFERRED EMBODIMENT

Figure 1:
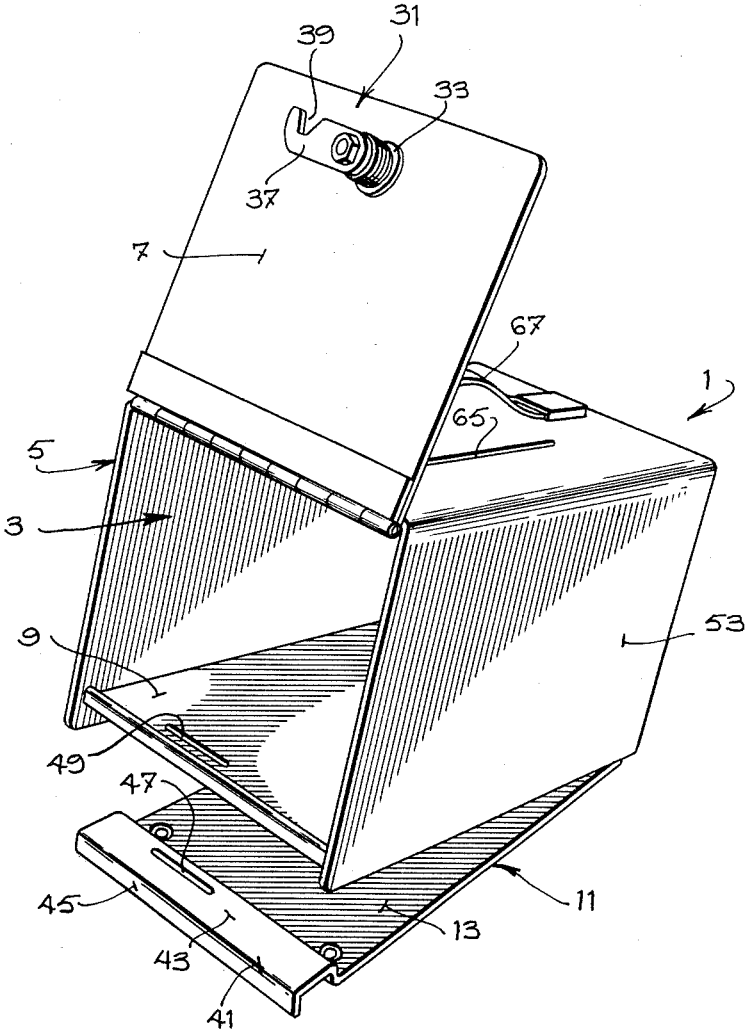
FIG. 1 is a perspective view of a safety box assembly, made according to the invention, wherein the container is shown being mounted on the base member with the door in open position.

The improved safety box assembly as shown in the drawings, comprises a container 1 defining an enclosure 3 for the safekeeping of valuables, such as money and jewels, and having wall edges at one end defining an access opening 5. A door 7 is hinged to the container 1 at the top of the opening 5 to allow it to swing about an axis which is parallel to the bottom wall of the container 1. The ensuing description will make it understandable that the door 7 may likewise be hinged along a side edge of the opening 5 of the container 1 for pivotal action about a vertical axis.

The improved safety box assembly also comprises a mounting base 11 which has a bottom wall 13. Fasteners such as screws 15 extend through the bottom wall 13 and are driven into a supporting or receiving support 17 (see FIG. 2). It will be noted that the screws 15 are located within the confines of the mounting base 11 so as to be hidden by the container 1 when the latter is mounted thereon, as clearly shown in the drawings, and therefore inaccessible if attempt is made to tamper with the assembly and remove it from the supporting wall 17.

Means are provided for removably securing the container 1 on the mounting base 11, over the fasteners 15. These means comprise releasable interlocking means 19 (see FIG. 2) provided at the end of the container 1 which is opposite to the opening 5, for securing the rear end of this container 1 to the rear end of the mounting base 11. These releasable interlocking means 19 comprise a slot 21 defined between the bottom wall 9 of the container 1 and the horizontal wall 25 of a L-shaped profile member 23 welded by its vertical wall 27 onto the rear wall of the container 1. The slot 21 is releasably engageable by a hook 29 provided for this purpose at the rear end of the bottom wall 13 of the mounting base 11. The hook 29 is advantageously formed by a bracket integrally formed in the rear end of the bottom wall 13 of the base 11, this bracket having a vertical portion extending upwardly at 90° from the bottom wall of the base and an horizontal portion rigidly projecting rearwardly from the upper edge of the vertical portion to match with the slot 21.

The means for removably securing the container 1 to the mounting base 11 also comprises locking means 31 for simultaneously locking the door 7 in the opening 5 and securing the front end of the container where is defined the opening 5, to the front end of the mounting base 11.

The locking means 31 comprises a lock mechanism 33 mounted through the door 7. The lock mechanism which is operable by a key 35, is already known and needs not be further detailed. The locking means 31 also comprises hooking means 37 movable by the lock mechanism 33. These hooking means 37 are made of a latch connected at one end to the end of the lock mechanism 33 which is located inside the enclosure 3 when the door 7 is closed. The latch 37 has its other end provided with a lateral recess or notch 39 capable of engaging and simultaneously hooking the bottom wall 9 of the container to the horizontal portion 43 of another bracket 41 integrally formed in the front end of the bottom wall 13 of the base 11. The bracket 41 formed in the front end of the bottom wall 13 of the base advantageously has the same height as the bracket 29 integrally formed in the rear end of this bottom wall 13 to ensure positioning of the container with its bottom wall 9 in parallel relationship with respect to the bottom wall 13 of the mounting base 11.

Figure 2:
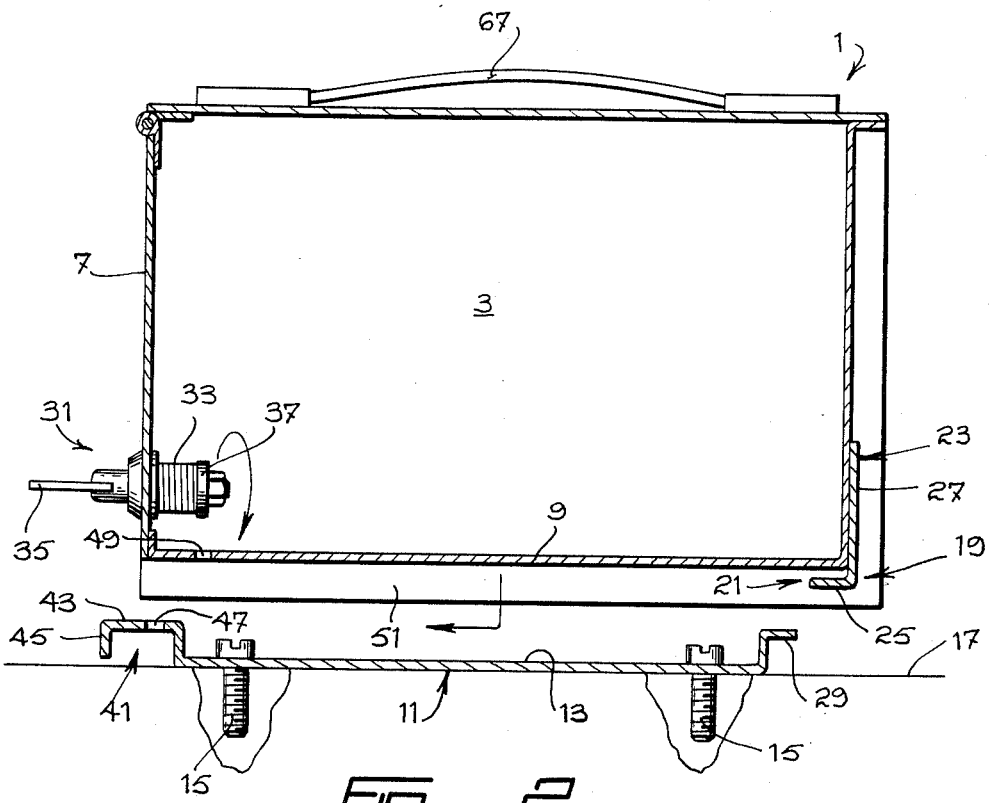
FIG. 2 is a longitudinal cross-sectional view of the safety box assembly of FIG. 1.
Figure 3:
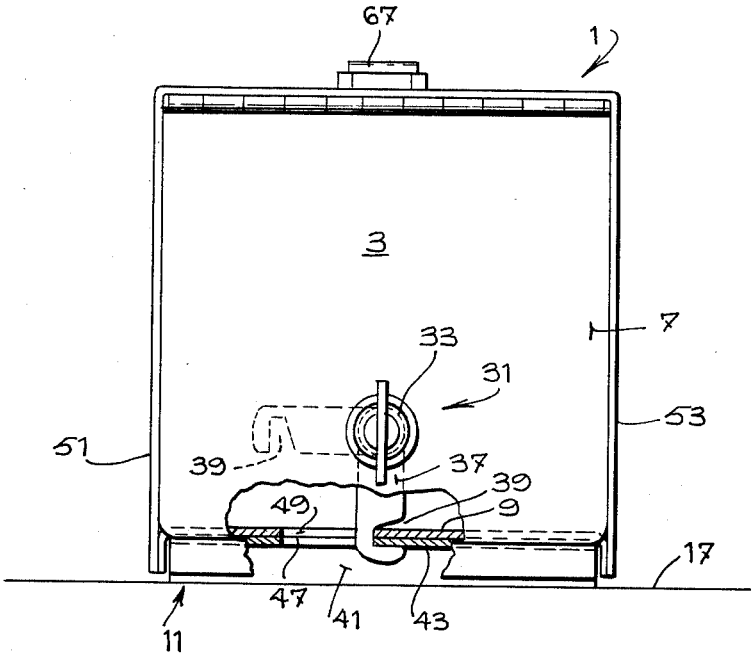
FIG. 3 is a front view of the assembly of FIGS. 1 and 2, with part of the door broken to show operation of the latch assembly.

When the container 1 is mounted onto the base 11, its bottom wall 9 will therefore bears onto the horizontal portions 29 and 43 of the rear and front brackets formed in the bottom wall 13 of the mounting base 11, as is clearly illustrated in FIGS. 2 and 3.

To allow the above mentioned engagement and hooking of the lateral notch 39 of the latch 37 in the bottom wall 9 of the container and the horizontal portion 43 of the bracket 41 when the door is closed, retaining means are provided for on both the container 1 and the mounting base 11. These retaining means advantageously consist of a pair of facing slots 47 and 49 respectively made in the bottom wall 9 of the container and the horizontal portion 43 of the bracket 41 which is in contact with the bottom wall 9 when the container 1 is mounted onto the base 11. The slots 47 and 49 are positioned to cooperate with the latch 37 and receive the notched end of this latch when the same is rotated in a plane substantially parallel to the plane of the door 7, by operation of the lock mechanism 33 with the key.

As clearly shown in FIG. 3, the notch 39 is sized to hook onto the bottom wall 9 of the container 1 and the horizontal portion 43 of the bracket 41 when the same are adjacent, and to rigidly retain these wall and portion in adjacent position.

To present access to the notched end of the latch 37 when the door is closed and the lock mechanism has been operated, the front edge 47 of the horizontal portion 43 of the bracket 41 formed at the front end of the mounting base 11 is preferably bent downwardly at 90° to define a vertical closing wall. Similarly, to prevent lateral access to the fasteners or screws 15, the side walls 51 and 53 of the container 1 are sized to slightly extend downwardly pass the bottom wall 9 of the container to cover both sides of the mounting base 11 as clearly shown in FIG. 3.

As can now be understood, mere installation of the container 1 over the mounting base 11 with the slot 21 provided under the bottom wall 9 of the container 1 engaged with the hook 29 provided at the rear end of the mounting base 11, followed by a mere rotation of the latch 37 using the key 35 for operating the lock mechanism 33, causes the lateral notch 39 provided at the end of the latch 37 to engage and hook the bottom wall of the container to the bracket 41 at the front end of the mounting base 11. This in turn causes simultaneous attachement of the door, container and mounting base all together with the door locked in closed position and the container rigidly secured onto the mounting base 11.

Since the safety box assembly is intended to collect valuables and, in the context of use mentioned above, a narrow slot 65 (shown in FIG. 1 only) may be provided through the top wall of container 1, this slot being of course sufficiently wide to permit the insertion of valuables in the enclosure 3 but sufficiently narrow to present hand access thereto. A handle 67 may also be provided onto the top wall of the container to serve for carrying the container 1 when it is released from the mounting base 11.

It will thus be appreciated, from the above description, that the present invention makes available a safety box assembly that can be put together and locked with extreme simplicity so that it can be achieved by any unskilled person. Inversely, the container 1 can be removed from the mounting base 11 extremely easily since it only requires unlocking of the lock 31.

I claim:

1. An improved safety box assembly of the type comprising:

(a) a container defining an enclosure for the safekeeping of valuables, said container having a bottom wall and wall edges at one end defining an opening;

(b) a door hinged to the container for closing the opening;

(c) a mounting base having a bottom wall and means for allowing rigid fixation of said bottom wall onto a supporting surface; and (d) means for removably securing the container onto the mounting base over the fastening means whereby to render said fastening means inaccessible when said container is so secured, said securing means comprising:

releasable interlocking means at the end of the container which is opposite to the opening for securing said opposite end to one end of the mounting base; and locking means for simultaneously locking the door in the opening and securing the end of said container where is defined the opening to the other end of the mounting base, the improvement wherein said locking means comprises:

a lock mechanism mounted on and fixed to the door of the container;

hooking means movably by said lock mechanism; and retaining means on the container and mounting base respectively, for simultaneously receiving said hooking means when the door is locked, whereby engagement of said hooking means in said retaining means when the door is closed and the lock mechanism operated, causes simultaneous attachment of the door, the container and the mounting base by said hooking means with the door locked in closed position and the container secured onto the mounting base, wherein said improved assembly further comprises a bracket upstanding from the bottom wall of the base, said bracket including a horizontal wall extending parallel to the bottom wall of the base in spaced apart position with respect thereto for supporting the opened end of the container when said container has its other end interlocked with the mounting base, and wherein said retaining means for receiving the hooking means consist of a pair of facing slots respectively provided for in the bottom wall of the container and the horizontal wall of the bracket in contact with said bottom wall of the container, said slots being positioned to receive the hooking means when the door is closed and the lock mechanism operated.

2. The improved assembly of claim 1, wherein said hooking means comprises a latch connected at one end to the lock mechanism, said latch having its other end provided with a lateral notch capable of engaging and simultaneously hooking the bottom wall of the container and the horizontal wall of the bracket of the mounting base when the door is closed and the latch is moved through the facing slots by operation of the lock mechanism.

3. The improved assembly of claim 2, wherein the lock mechanism includes means to rotate the latch in a plane substantially parallel to the door between a disengaged position where the door is openable and the container removable from the base, and an engaged position where the notched end of the latch is inserted in the facing slots and hooked onto the bottom wall of the container and the horizontal wall of the bracket of the mounting base, respectively.

4. The improved assembly of claim 3, wherein the release interlocking means comprises a slot provided at the bottom end of the container which is opposite to the opening, said slot being releasably engageable by a hook provided for at the corresponding end of the bottom wall of the mounting base.

5. The improved assembly of claim 4, wherein the hook at the end of the bottom wall of the base opposite to the opening of the container is formed by a bracket extending upwardly from said bottom wall of said base.

6. The improved assembly of claim 5, wherein the brackets provided on the mounting base for respectively supporting the opened end of the container and engaging the slot forming the releasable interlocking means, have the same height and are integrally formed in said bottom wall at the ends thereof.

7. The improved assembly of claim 6, wherein the bracket formed in the bottom wall of the mounting base for engaging the slot forming the releasable interlocking means, projects rearwardly away from the opened end of the container whereas the other bracket projects forwardly.

8. The improved assembly of claim 7, wherein the edge of the horizontal wall of the bracket formed at the end of the mounting base close to the opening of the container is bent downwardly at 90° to define a vertical, closing wall.

9. The improved assembly of claim 8, wherein the container has a pair of side walls extending downwardly past its bottom wall to cover both sides of the mounting base.

10. The improved assembly of claim 9, wherein the door is hinged to the container for pivotal action about an axis parallel to the bottom wall of said container.

11. The improved assembly of claim 10, including a handle for carrying the container when released from the mounting base.

12. The improved assembly of claim 11, further comprising a slot through the top wall of the container to give limited access thereto for the insertion of valuables, said slot being of a size suitable to prevent hand access thereinto.

13. The improved assembly of claim 3, wherein the door is hinged to the container for pivotal action about an axis parallel to the bottom wall of the container.

14. The improved assembly of claim 13, including a handle for carrying the container when released from the mounting base.

* * * * *